US010107118B2

(12) United States Patent
Ols et al.

(10) Patent No.: US 10,107,118 B2
(45) Date of Patent: Oct. 23, 2018

(54) FLOW DISCOURAGER FOR VANE SEALING AREA OF A GAS TURBINE ENGINE

(71) Applicant: UNITED TECHNOLOGIES CORPORATION, Hartford, CT (US)

(72) Inventors: John T Ols, Northborough, MA (US); Richard N Allen, West Hartford, CT (US); Paul K Sanchez, Wellington, FL (US); Steven D Porter, Wethersfield, CT (US); Jonathan Lemoine, Vernon, CT (US)

(73) Assignee: United Technologies Corporation, Farmington, CT (US)

( * ) Notice: Subject to any disclaimer, the term of this patent is extended or adjusted under 35 U.S.C. 154(b) by 316 days.

(21) Appl. No.: 14/900,737

(22) PCT Filed: Jun. 27, 2014

(86) PCT No.: PCT/US2014/044631
§ 371 (c)(1),
(2) Date: Dec. 22, 2015

(87) PCT Pub. No.: WO2014/210496
PCT Pub. Date: Dec. 31, 2014

(65) Prior Publication Data

US 2016/0153296 A1 Jun. 2, 2016

Related U.S. Application Data

(60) Provisional application No. 61/840,908, filed on Jun. 28, 2013.

(51) Int. Cl.

| | |
|---|---|
| ***F01D 11/02*** | (2006.01) |
| ***F01D 9/04*** | (2006.01) |
| ***F01D 5/08*** | (2006.01) |
| ***F01D 11/00*** | (2006.01) |

(52) U.S. Cl.
CPC ..... *F01D 9/041* (2013.01); *F01D 5/082* (2013.01); *F01D 11/003* (2013.01); *F01D 11/02* (2013.01); *F05D 2240/12* (2013.01); *F05D 2240/80* (2013.01)

(58) Field of Classification Search
CPC ..... F01D 5/08; F01D 9/041; F01D 11/0005; F01D 25/08; F05D 2240/15; F05D 2240/80
See application file for complete search history.

(56) References Cited

U.S. PATENT DOCUMENTS

| | | | | |
|---|---|---|---|---|
| 5,226,788 | A | 7/1993 | Fledderjohn | |
| 5,292,227 | A * | 3/1994 | Czachor | F01D 25/162 415/142 |
| 5,429,478 | A * | 7/1995 | Krizan | F01D 11/001 415/115 |
| 6,652,229 | B2 * | 11/2003 | Lu | F01D 11/005 415/173.3 |
| 6,983,608 | B2 * | 1/2006 | Allen, Jr. | F01D 9/00 29/890.01 |

(Continued)

*Primary Examiner* — Ninh H Nguyen
(74) *Attorney, Agent, or Firm* — Bachman & LaPointe, P.C.

(57) ABSTRACT

An interface within a gas turbine engine includes a sealing surface defined by a portion of a vane platform. A seal is in contact with said sealing surface. A barrier is transverse to the sealing surface.

20 Claims, 8 Drawing Sheets

(56) References Cited

U.S. PATENT DOCUMENTS

| | | | | |
|---|---|---|---|---|
| 7,121,793 | B2 * | 10/2006 | Correia | F01D 9/041 415/191 |
| 8,152,451 | B2 * | 4/2012 | Manteiga | F01D 9/02 415/115 |
| 8,371,127 | B2 * | 2/2013 | Durocher | F01D 5/082 415/115 |
| 2006/0056961 | A1 | 3/2006 | Czachor et al. | |
| 2011/0079019 | A1 | 4/2011 | Durocher et al. | |
| 2011/0081237 | A1 | 4/2011 | Durocher et al. | |
| 2013/0078080 | A1 | 3/2013 | Durocher et al. | |

* cited by examiner

FLOW DISCOURAGER FOR VANE SEALING AREA OF A GAS TURBINE ENGINE

CROSS-REFERENCE TO RELATED APPLICATIONS

This application claims priority to U.S. Provisional Patent Application No. 61/840,908 filed Jun. 28, 2013, which is hereby incorporated herein by reference in its entirety.

BACKGROUND

The present disclosure relates to a gas turbine engine and, more particularly, to an interface therefore.

A Mid Turbine Frame (MTF) of a gas turbine engine typically includes a plurality of hollow vanes arranged in a ring-vane-ring structure. The rings define inner and outer boundaries of a core gas path while the vanes are disposed across the gas path. Tie rods extend through the hollow vanes to interconnect an engine mount ring and a bearing compartment.

The MTF is subject to thermal stresses from combustion gases along the core gas path, which may reduce operational life thereof.

SUMMARY

An interface within a gas turbine is provided engine according to one disclosed non-limiting embodiment of the present disclosure. This interface includes a sealing surface defined by a portion of a vane platform. A seal is in contact with the sealing surface and a barrier is transverse to the sealing surface.

In a further embodiment of the present disclosure, the barrier extends from a low pressure turbine seal.

In a further embodiment of any of the foregoing embodiments of the present disclosure, the barrier is transverse to the sealing surface and extends radially inboard with respect to an engine central longitudinal axis and toward the vane platform.

In a further embodiment of any of the foregoing embodiments of the present disclosure, the barrier is transverse to the sealing surface and extends radially outboard with respect to an engine central longitudinal axis and toward the vane platform.

In a further embodiment of any of the foregoing embodiments of the present disclosure, the seal surface is parallel to an engine central longitudinal axis.

In a further embodiment of any of the foregoing embodiments of the present disclosure, the barrier is angled with respect to the seal to align with a trailing edge of a vane that extends from the vane platform.

In a further embodiment of any of the foregoing embodiments of the present disclosure, the barrier is L-shaped in cross-section.

In a further embodiment of any of the foregoing embodiments of the present disclosure, the seal is in contact with the barrier.

In a further embodiment of any of the foregoing embodiments of the present disclosure, the barrier is step-shaped in cross-section.

A mid turbine frame module for a gas turbine engine is provided according to another disclosed non-limiting embodiment of the present disclosure. This mid turbine frame module includes an outer turbine case about an axis, an inner case about the axis, and a mid-turbine frame radially between the outer turbine case and the inner case.

The mid turbine frame includes an inner vane platform, an outer vane platform and a plurality of vanes between the inner vane platform and the outer vane platform. The mid turbine frame module also includes a barrier and a seal in contact with the mid-turbine frame at a sealing surface. The barrier is transverse to the vane platform to at least partially shield the sealing surface from recirculating air within a recirculating air cavity adjacent to the inner platform.

In a further embodiment of any of the foregoing embodiments of the present disclosure, the barrier extends toward, but is not in contact with, the inner vane platform the barrier axially aligned with an edge of a vane that extends from the vane platform.

In a further embodiment of any of the foregoing embodiments of the present disclosure, the barrier extends toward, but is not in contact with, the outer vane platform the barrier axially aligned with an edge of a vane that extends from the vane platform.

In a further embodiment of any of the foregoing embodiments of the present disclosure, a plurality of tie-rods are include through the mid turbine frame.

In a further embodiment of any of the foregoing embodiments of the present disclosure, the barrier is between the seal and the recirculating air cavity.

In a further embodiment of any of the foregoing embodiments of the present disclosure, the seal is mounted to the inner case. The barrier extends from the inner case toward, but not in contact with, the inner vane platform.

A method of reducing a temperature gradient within a portion of a wall defining a recirculating air passage in a gas turbine engine is provided according to another disclosed non-limiting embodiment of the present disclosure. This method includes orienting a barrier relative to a vane platform to at least partially shield a sealing surface extending from the wall from recirculating air within a recirculating air cavity.

In a further embodiment of any of the foregoing embodiments of the present disclosure, the method includes extending the barrier toward but not into contact with the wall.

In a further embodiment of any of the foregoing embodiments of the present disclosure, the method includes the barrier is located between the recirculating air cavity and a seal in contact with the wall.

In a further embodiment of any of the foregoing embodiments of the present disclosure, the wall is a vane platform which supports a plurality of vanes.

In a further embodiment of any of the foregoing embodiments of the present disclosure, a core airflow flows through the core gas passage. The recirculating air cavity is configured to recirculate a secondary airflow.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
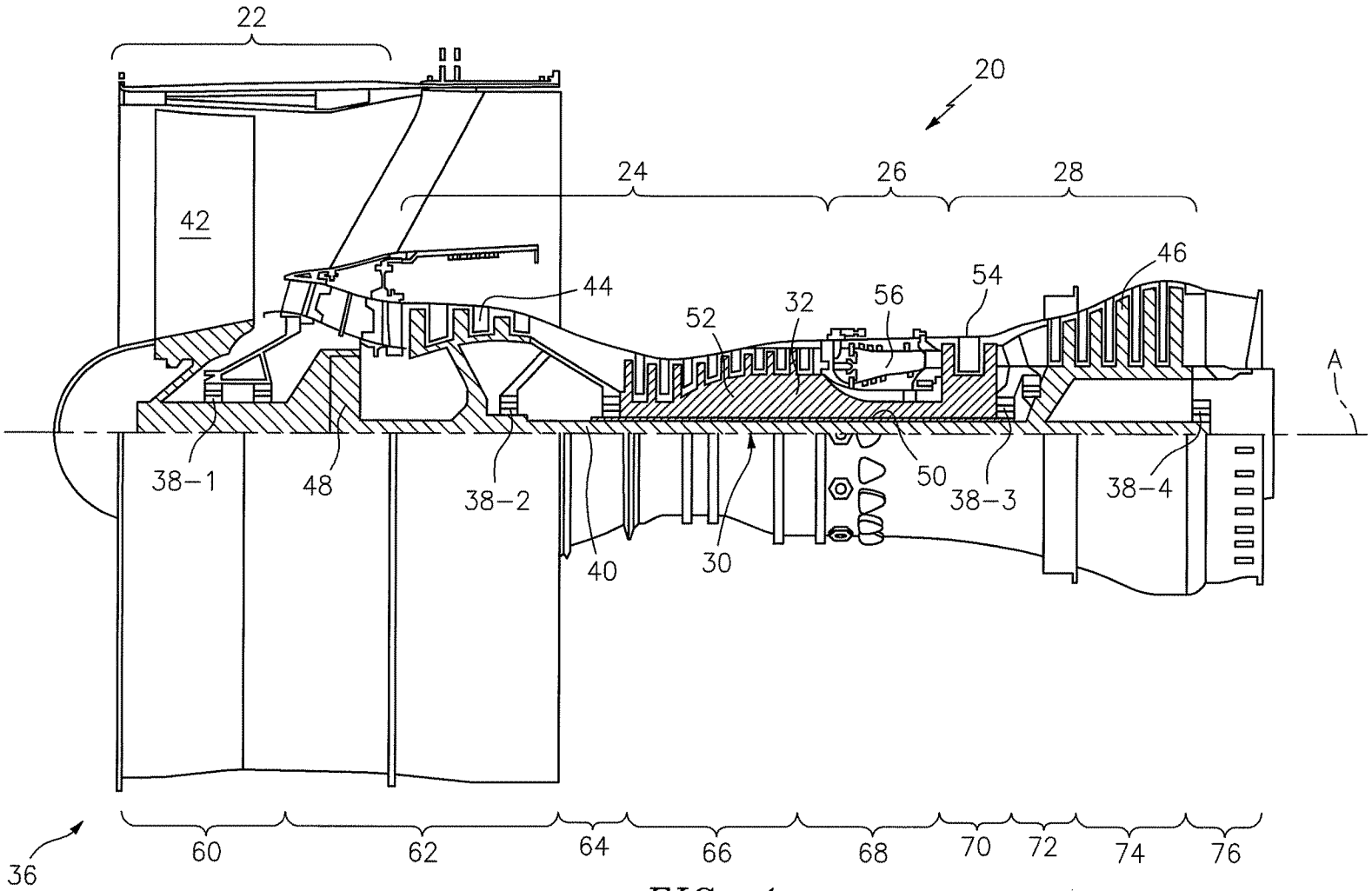
FIG. 1 is a schematic cross-sectional view of a geared architecture gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines architectures such as a low-bypass turbofan may also include an augmentor section (not shown) among other systems or features. Although schematically illustrated as a turbofan in the disclosed non-limiting embodiment, it should be understood that the concepts described herein are not limited to use with turbofans as the teachings may be applied to other types of turbine engines to include but not limited to a three-spool (plus fan) engine wherein an intermediate spool includes an intermediate pressure compressor (IPC) between a low pressure compressor (LPC) and a high pressure compressor (HPC) with an intermediate pressure turbine (IPT) between a high pressure turbine (HPT) and a low pressure turbine (LPT) as well as other engine architectures such as turbojets, turboshafts, open rotors and industrial gas turbines.

The fan section 22 drives air along a bypass flowpath and a core flowpath while the compressor section 24 drives air along the core flowpath for compression and communication into the combustor section 26, and subsequent expansion through the turbine section 28. The engine 20 generally includes a low-speed spool 30 and a high-speed spool 32 mounted for rotation about an engine central longitudinal axis A relative to an engine case assembly 36 via several bearing compartments 38-1, 38-2, 38-3, 38-4. The bearing compartments 38-1, 38-2, 38-3, 38-4 in the disclosed non-limiting embodiment are defined herein as a forward bearing compartment 38-1, a mid-bearing compartment 38-2 axially aft of the forward bearing compartment 38-1, a mid-turbine bearing compartment 38-3 axially aft of the mid-bearing compartment 38-2 and a rear bearing compartment 38-4 axially aft of the mid-turbine bearing compartment 38-3. It should be appreciated that additional or alternative bearing compartments may be provided.

The low spool 30 generally includes an inner shaft 40 that interconnects a fan 42, a low-pressure compressor 44 ("LPC") and a low-pressure turbine 46 ("LPT"). The inner shaft 40 drives the fan 42 through a geared architecture 48 to drive the fan 42 at a lower speed than the low spool 30. The high spool 32 includes an outer shaft 50 that interconnects a high-pressure compressor 52 ("HPC") and a high-pressure turbine 54 ("HPT"). A combustor 56 is arranged between the HPC 52 and the HPT 54. The inner shaft 40 and the outer shaft 50 are concentric and rotate about the engine central longitudinal axis A, which is collinear with longitudinal axes of the inner and the outer shafts 40 and 50.

Core airflow is compressed by the LPC 44 then the HPC 52, mixed with the fuel and burned in the combustor 56, then expanded over the HPT 54 and the LPT 46. The HPT 54 and the LPT 46 drive the respective high spool 32 and low spool 30 in response to the expansion.

In one example, the gas turbine engine 20 is a high-bypass geared architecture engine in which the bypass ratio is greater than about six (6:1). The geared architecture 48 can include an epicyclic gear system, such as a planetary gear system, star gear system or other system. The example epicyclic gear train has a gear reduction ratio of greater than about 2.3, and in another example is greater than about 2.5 with a gear system efficiency greater than approximately 98%. The geared turbofan enables operation of the low spool 30 at higher speeds which can increase the operational efficiency of the LPC 44 and LPT 46 and render increased pressure in a fewer number of stages.

A pressure ratio associated with the LPT 46 is pressure measured prior to the inlet of the LPT 46 as related to the pressure at the outlet of the LPT 46 prior to an exhaust nozzle of the gas turbine engine 20. In one example, the bypass ratio of the gas turbine engine 20 is greater than about ten (10:1), the fan diameter is significantly larger than that of the LPC 44, and the LPT 46 has a pressure ratio that is greater than about five (5:1). It should be understood, however, that the above parameters are only exemplary of embodiments of a geared architecture engine, and that the present disclosure is applicable to other gas turbine engines, including, for example, direct drive turbofans.

A significant amount of thrust is provided by the bypass flow due to the high bypass ratio. The fan section 22 of the gas turbine engine 20 may be designed for a particular flight condition—typically cruise at about 0.8 Mach and about 35,000 feet. This flight condition, with the gas turbine engine 20 at its best fuel consumption, is also known as bucket cruise Thrust Specific Fuel. Consumption (TSFC). TSFC is an industry standard parameter of fuel consumption per unit of thrust.

Fan Pressure Ratio is the pressure ratio across a blade of the fan section 22 without a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $(\text{"T"}/518.7)^{0.5}$. The Low Corrected Fan Tip Speed according to one non-limiting embodiment of the example gas turbine engine 20 is less than about 1150 fps (351 m/s).

The engine case assembly 36 generally includes a plurality of modules, including a fan case module 60, an intermediate case module 62, a Low Pressure Compressor (LPC) module 64, a High Pressure Compressor (HPC) module 66, a diffuser module 68, a High Pressure Turbine (HPT) module 70, a mid-turbine frame (MTF) module 72, a Low Pressure Turbine (LPT) module 74, and a Turbine Exhaust Case (TEC) module 76. It should be understood that additional or alternative modules might be utilized to form the engine case assembly 36.

Figure 2:
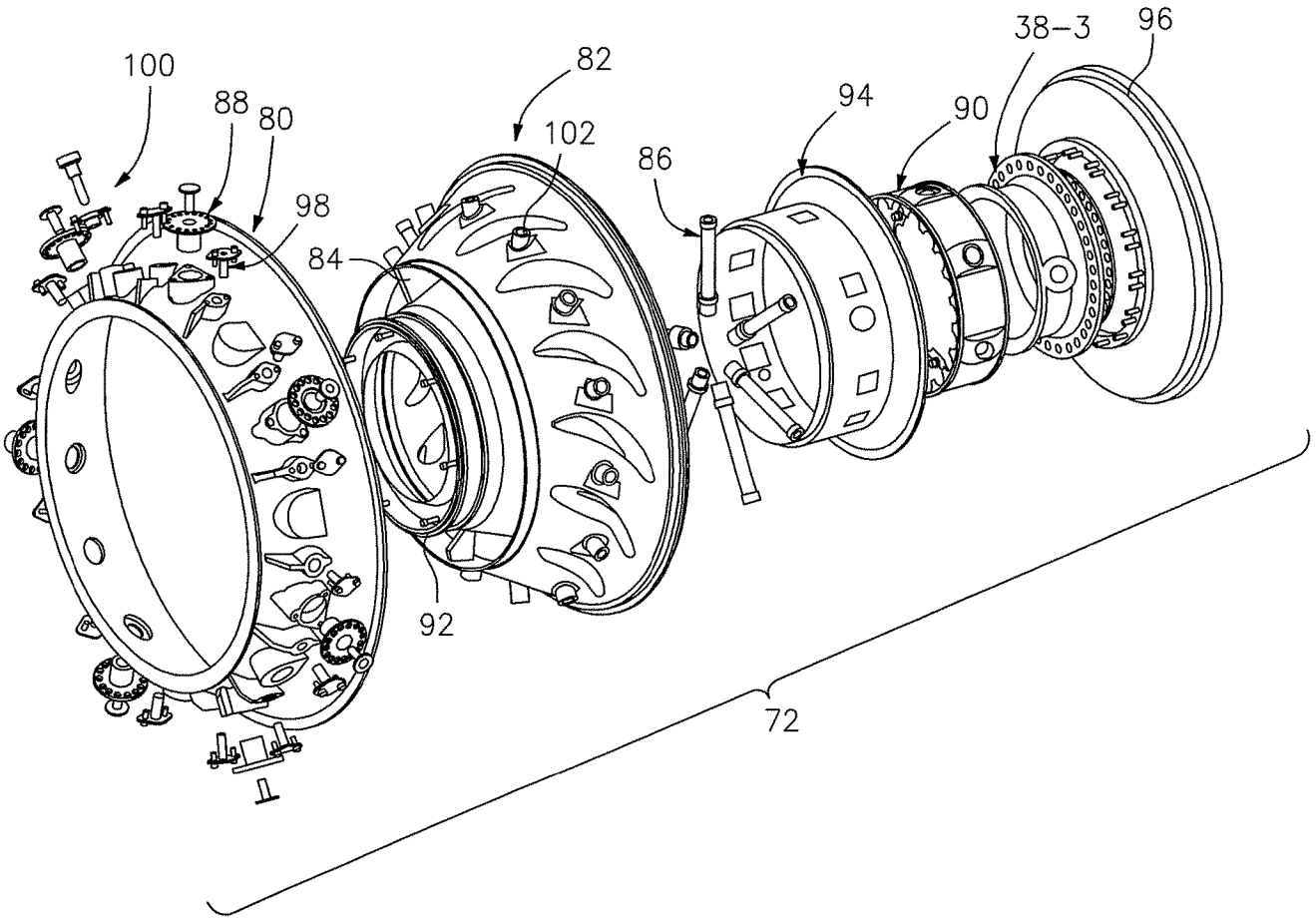
FIG. 2 is an exploded view of a Mid-Turbine Frame module.

With reference to FIG. 2, the MTF module 72 generally includes an outer turbine case 80, a mid-turbine frame (MTF) 82 which defines a plurality of hollow vanes 84, a plurality of tie rods 86, a multiple of tie rod nuts 88, an inner case 90, a HPT seal 92, a heat shield 94, a LPT seal 96, a multiple of centering pins 98 and a borescope plug assembly 100. The MTF module 72 supports the mid-bearing compartment 38-3 through which the inner and outer shafts 40, 50 are rotationally supported. It should be appreciated that various other components may additionally or alternatively be provided within the MTF 82, for example only, the LPT seal 96 may alternatively be referred to as an intermediate seal in other engine architectures.

Each of the tie rods 86 are mounted to the inner case 90 and extend through a respective vanes 84 to be fastened to the outer turbine case 80 with the multiple of tie rod nuts 88. That is, each tie rod 86 is typically sheathed by a vane 84 through which the tie rod 86 passes (see FIG. 3). The other vanes 84 may alternatively or additionally provide other service paths. The multiple of centering pins 98 are circumferentially distributed between the vanes 84 to engage bosses 102 on the MTF 82 to locate the MTF 82 with respect to the inner case 90 and the outer turbine case 80. It should be understood that various attachment arrangements may alternatively or additionally be utilized.

Figure 4:
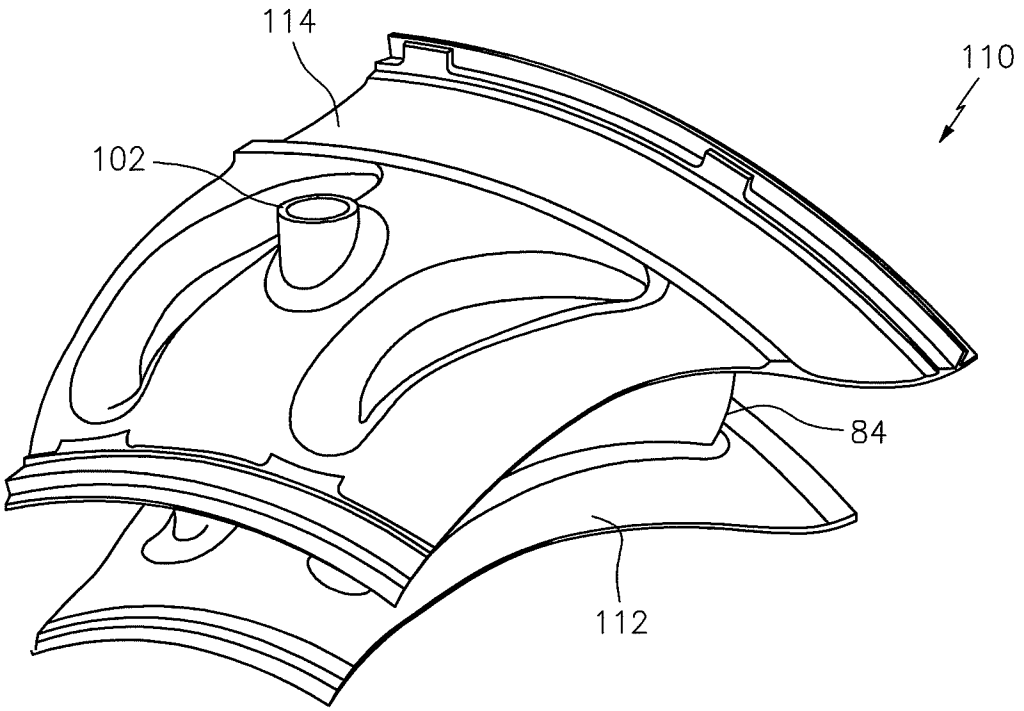
FIG. 4 is a perspective view of a Mid-Turbine Frame segment.

With reference to FIG. 4, the MTF 82 in one disclosed non-limiting embodiment is manufactured of a multiple of sectors 110 (one shown in FIG. 4). The multiple of sectors 110 are brazed together to define a ring-vane-ring configuration in which an inner platform 112 is spaced from an outer platform 114 by the multiple of vanes 84. Alternatively, the MTF 82 may be cast as a unitary component.

Figure 3:
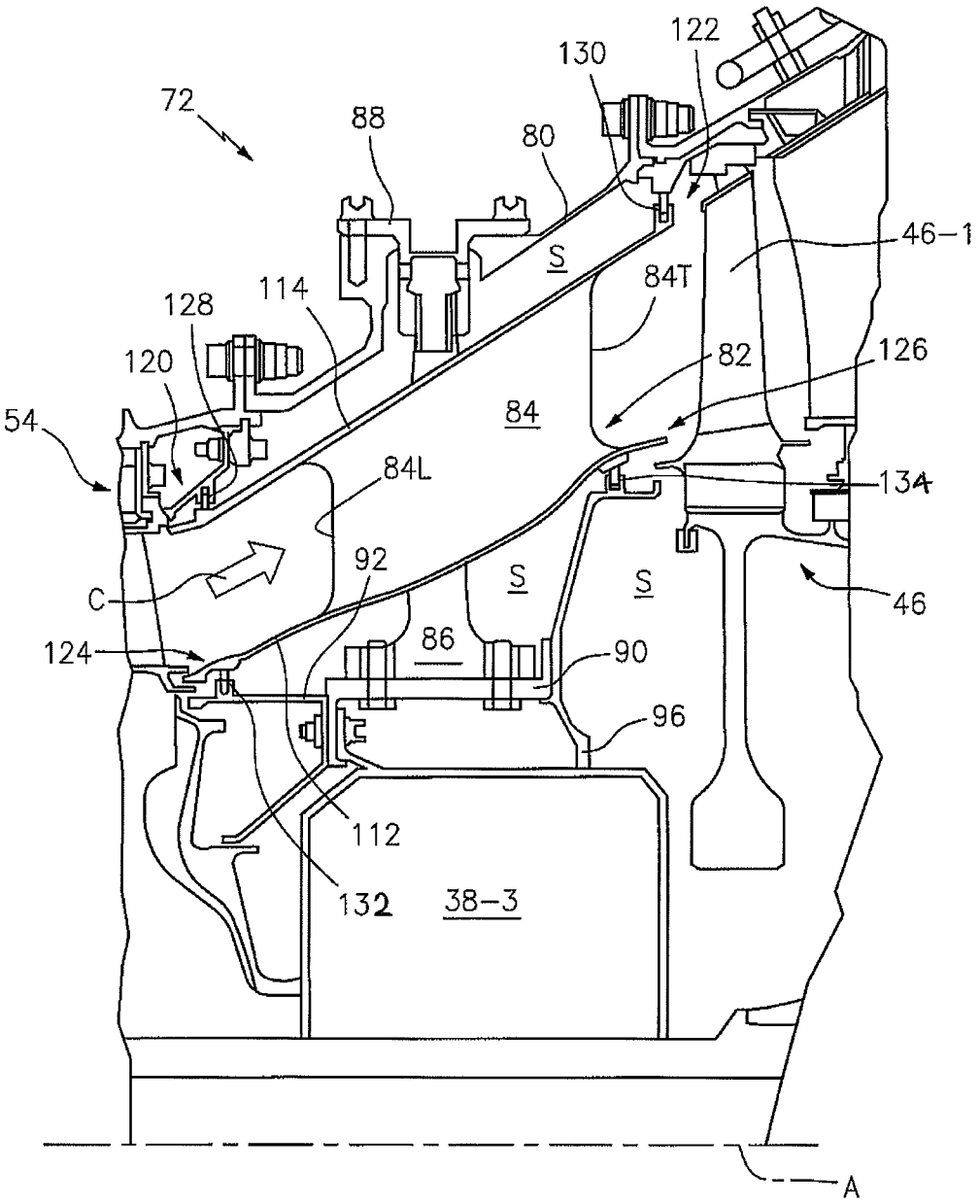
FIG. 3 is a cross-sectional view of the Mid-Turbine Frame module through a tie-rod.

Referring to FIG. 3, the MTF 82 is sealed to the outer turbine case 80 at an outer forward seal interface 120 and an outer aft seal interface 122. The MTF 82 is also sealed to the HPT seal 92, which is attached to the inner case 90 at an inner forward seal interface 124, and is also sealed to the LPT seal 96 at an inner aft seal interface 126. Each seal interface 120, 122, 124, 126 includes a seal 128, 130, 132, 134 (best seen in FIG. 5) such as a ring seal, W-seal, C-seal or other seal to seal the MTF 82 from a secondary airflow. The secondary airflow S defined herein as any airflow different and cooler than the core airflow C.

The secondary airflow can be utilized for multiple purposes, including, for example, cooling and pressurization, substantially radially outward injection (illustrated schematically by arrow S) for guidance into a recirculating air cavity 128 aft of the MTF 82, forward of a first rotor 46-1 of the LPT 46 where the secondary airflow may at least partially form a recirculating airflow region. It will be appreciated that secondary airflow is typically injected proximate each seal interface 120, 122, 124, 126, and that the description herein of the inner aft seal interface 126 is merely representative and exemplary of at least, but not limited to, each seal interface 120, 122, 124, 126.

The secondary airflow re-circulates in the recirculating air cavity 128 and "scrubs" the non-gas path side of the inner platform 112, which can have a significant affect on heat transfer. That is, the secondary airflow within the recirculating air cavity 128, which is cooler than the core airflow C, significantly cools the MTF 82 and may form a thermal ring-vane-ring thermal conflict as the MTF is subject to both the core airflow C and the secondary airflow S. It should be appreciated that "recirculates" as defined herein is the secondary airflow, which may even momentarily stagnate in regions adjacent the seal interfaces 120, 122, 124, 126 prior to communication into the core airflow C that flows around the vanes 84.

Figure 5:
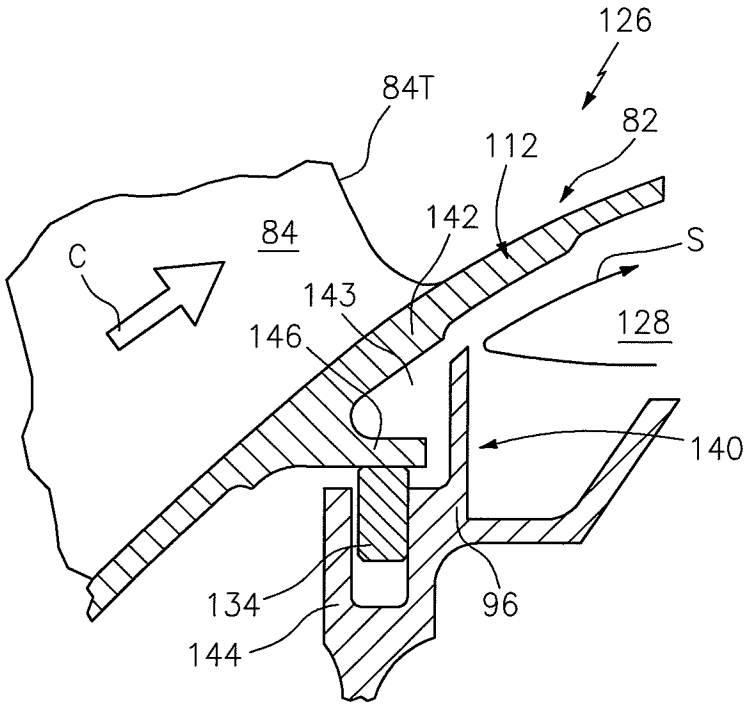
FIG. 5 is an expanded cross-sectional view of an inner aft seal interface of the Mid-Turbine Frame module according to one disclosed non-limiting embodiment.
Figure 6:
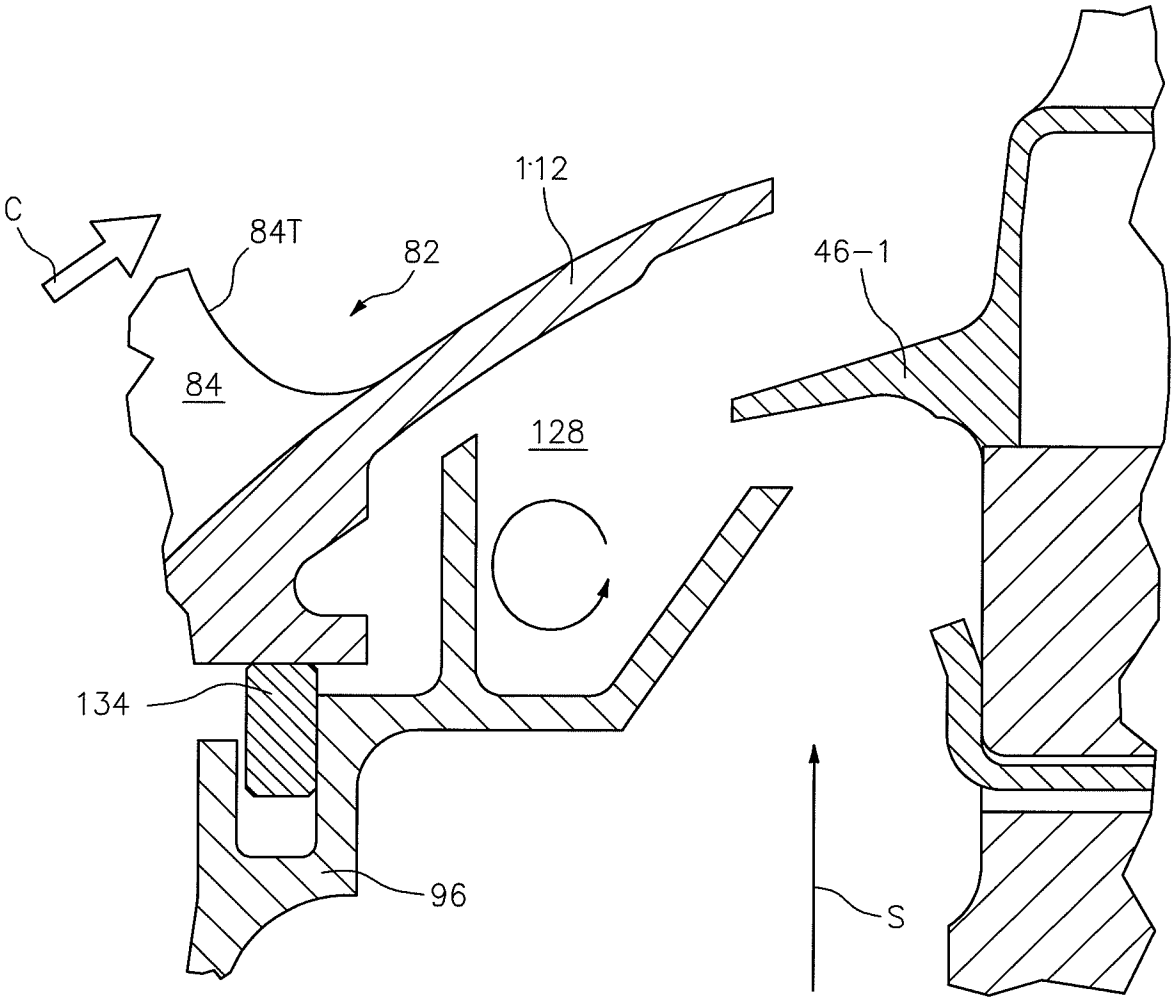
FIG. 6 is an expanded cross-sectional view of the inner aft seal interface showing a recirculation air cavity.

With reference to FIG. 5, a radial barrier 140 shields a portion of the inner platform 112 adjacent to the inner aft seal interface 126 of the MTF 82 from the secondary air S to thereby permit an increase in the temperature of a section 142 of the inner platform 112. That is, at least the section 142 of the inner platform 112 is allowed to increase in temperature as the secondary airflow is shielded therefrom to minimize the "scrub". This increase in temperature reduces the structural thermal conflict within the MTF 82. It should be appreciated that although the inner aft seal interface 126 is illustrated and described in detail in the disclosed non-limiting embodiments, any of the seal interfaces 120, 122, 124, 126 (see FIG. 3) will benefit herefrom.

Figure 7:
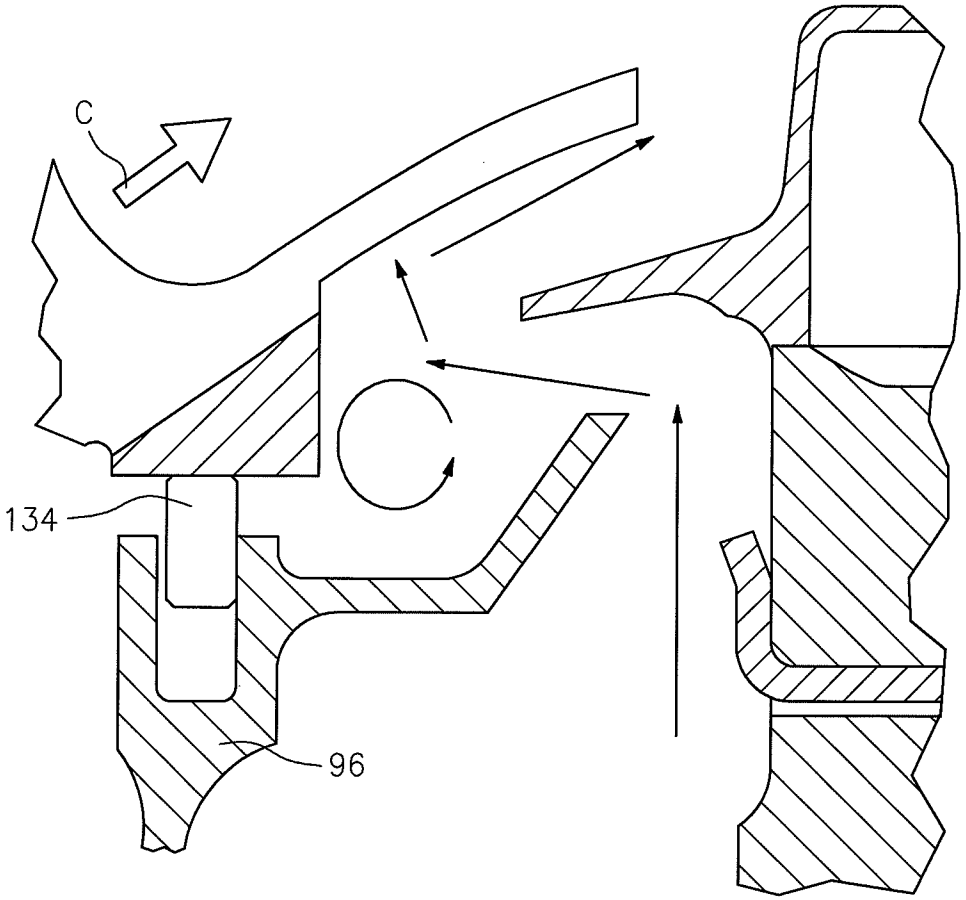
FIG. 7 (RELATED ART)
FIG. 7 is an expanded cross-sectional view of a related art recirculation air cavity.

In this disclosed non-limiting embodiment, the radial barrier 140 extends from the LPT seal 96 toward, but not into contact with, the inner platform 112. The seal 134 is mounted within a groove 144 of the LPT seal 96 and extends generally parallel to the radial barrier 140 and into contact with an axial flange 146 that extends from the inner platform 112. That is, the radial barrier 140 extends generally beyond the seal 134 and transverse to the inner platform 112. The radial barrier 140 is thereby located between the seal 134 and the secondary airflow S that re-circulates in the recirculating air cavity 128 as compared to a conventional interface (related art; FIG. 7).

Figure 8:
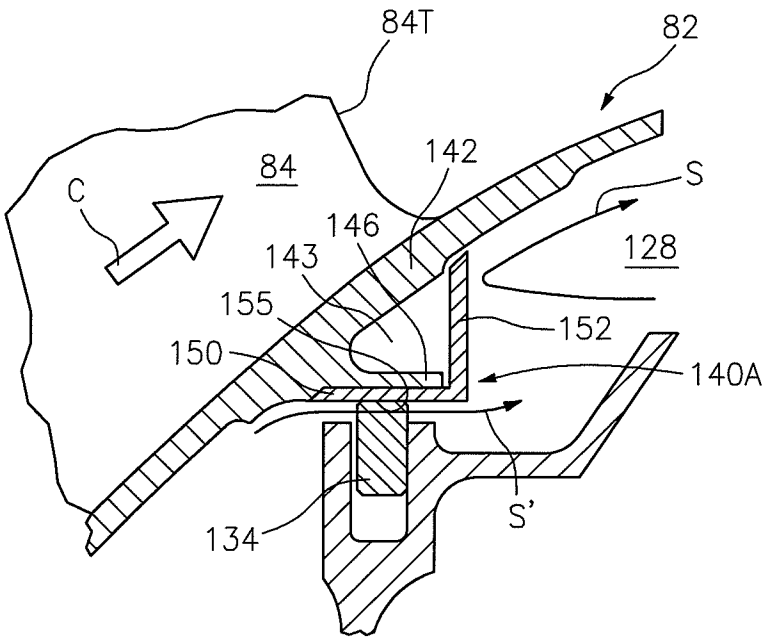
FIG. 8 is an expanded cross-sectional view of an inner aft seal interface of the Mid-Turbine Frame module according to another disclosed non-limiting embodiment.

With reference to FIG. 8, a radial barrier 140A in another disclosed non-limiting embodiment is L-shaped in cross-section. The radial barrier 140A may be brazed or otherwise mounted to the MTF 82. The radial barrier 140A—being L-shaped—includes an axial portion 150 transverse to a radial portion 152. The axial portion 150 of the radial barrier 140A provides a seal surface 155 for the seal 134 as well as isolate the axial flange 146 from secondary airflow (illustrated schematically by arrow S') that flows past the seal 134. That is, the seal 134 rides on the axial portion 150 rather than the MTF 82 to thereby further isolate the axial flange 146 and the section 142 of the inner platform 112.

Figure 9:
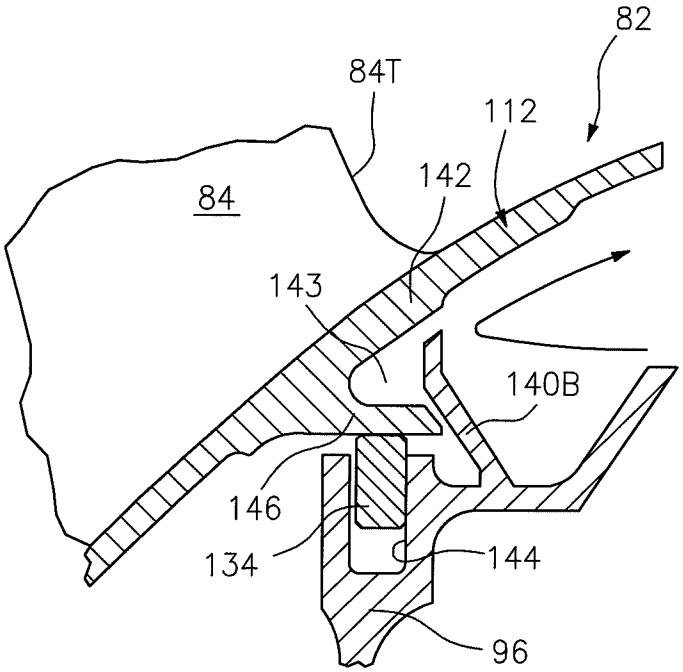
FIG. 9 is an expanded cross-sectional view of an inner aft seal interface of the Mid-Turbine Frame module according to another disclosed non-limiting embodiment.

With reference to FIG. 9, a radial barrier 140B in another disclosed non-limiting embodiment is angled with respect to the seal 134. That is, the radial barrier 140B need not be parallel to the seal 134. The radial barrier 140B may be angled or otherwise configured to align with a trailing edge 84T of the vane 84 and/or with respect to cavity 143 which may be present for weight and/or stress reduction. Such alignment facilitates a reduction in any thermal conflict between the vane 84 and the inner platform 112. It should be appreciated that such alignment is also applicable to a leading edge of the vane 84L for interfaces 120, 124.

Figure 10:
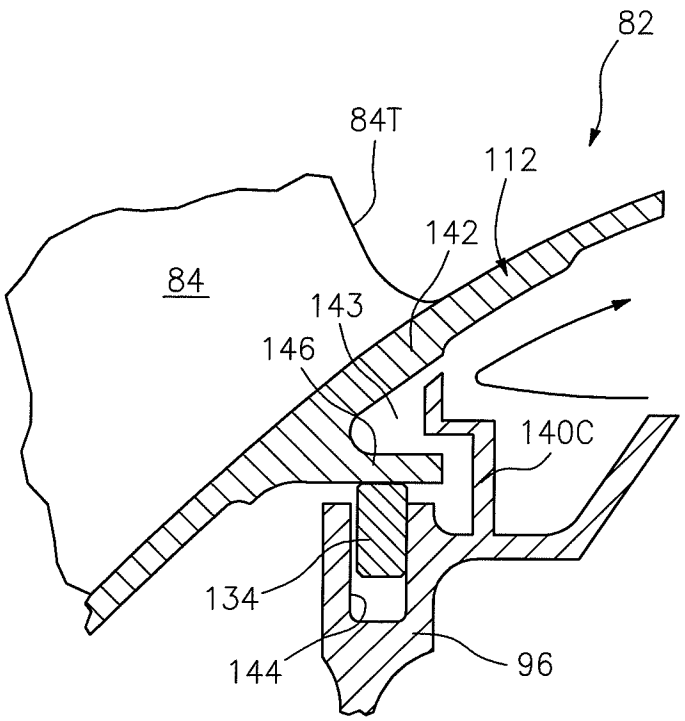
FIG. 10 is an expanded cross-sectional view of an inner aft seal interface of the Mid-Turbine Frame module according to another disclosed non-limiting embodiment.

With reference to FIG. 10, a radial barrier 140C in another disclosed non-limiting embodiment is step-shaped in cross-section. The radial barrier 140C steps toward the seal 134 to align with a trailing edge 84T of the vane 84.

Each seal interface 120, 122, 124, 126 facilitates a reduction in thermal stresses which thereby increases component life. The relatively lower stresses also may reduce maintenance and enable lighter weight designs.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the features within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. An interface within a gas turbine engine comprising:

a sealing surface defined by an axial flange that extends from a platform parallel to an engine central longitudinal axis;

a seal in contact with said sealing surface to seal from a secondary airflow; and a barrier that extends transverse and beyond said sealing surface with respect to the engine central longitudinal axis, said barrier located between said seal and the secondary airflow that recirculates in a recirculating air cavity.

2. The interface as recited in claim 1, wherein said barrier extends from a low pressure turbine seal.

3. The interface as recited in claim 1, wherein said barrier is transverse to said sealing surface and extends radially inboard with respect to engine central longitudinal axis and toward said vane platform.

4. The interface as recited in claim 1, wherein said seal surface is parallel to said engine central longitudinal axis.

5. The interface as recited in claim 1, wherein said barrier is angled with respect to said seal to align with a trailing edge of a vane that extends from said vane platform.

6. The interface as recited in claim 1, wherein said barrier is L-shaped in cross-section.

7. The interface as recited in claim 6, wherein said seal is in contact with said axial flange.

8. The interface as recited in claim 1, wherein said barrier is step-shaped in cross-section, said step-shape located radially beyond said sealing surface with respect to the engine central longitudinal axis.

9. The interface as recited in claim 1, wherein said barrier extends with respect to the engine central longitudinal axis toward said platform to permit an increase in temperature of a section of said vane platform and reduce a structural thermal conflict of said vane platform.

10. A mid turbine frame module for a gas turbine engine comprising:

an outer turbine case about an axis;

an inner case about said axis;

a mid-turbine frame radially between said outer turbine case and said inner case, said mid turbine frame includes an inner vane platform, an outer vane platform and a plurality of vanes between said inner vane platform and said outer vane platform;

a seal in contact with said mid-turbine frame at a sealing surface to seal from a secondary airflow; and a barrier that extends transverse and beyond said sealing surface with respect to the engine central longitudinal axis, said barrier located between said seal and the secondary airflow that recirculates in a recirculating air cavity.

11. The mid turbine frame module as recited in claim 10, wherein said barrier extends toward but is not in contact with said inner vane platform, said barrier axially aligned with an edge of a vane that extends from said vane platform.

12. The mid turbine frame module as recited in claim 10, wherein said barrier extends toward but is not in contact with said outer vane platform, said barrier axially aligned with an edge of a vane that extends from said vane platform.

13. The mid turbine frame module as recited in claim 10, further comprising a plurality of tie-rods through said mid turbine frame.

14. The mid turbine frame module as recited in claim 10, wherein said seal is mounted to said inner case, said barrier extends from said inner case toward but not in contact with, said inner vane platform.

15. A method of reducing a temperature gradient within a portion of a wall defining a core gas passage in a gas turbine engine, the method comprising:

orienting a barrier to extend transverse and beyond a sealing surface with respect to the engine central longitudinal axis to seal from a secondary airflow to at least partially shield the sealing surface from recirculating air, said barrier located between a seal in contact with said sealing surface and the secondary airflow that recirculates in a recirculating air cavity, said barrier extending with respect to the engine central longitudinal axis toward the vane platform to permit an increase in temperature of a section of a vane platform thereby reducing a structural thermal conflict with the vane platform.

16. The method as recited in claim 15, further comprising extending the barrier toward but not into contact with the wall.

17. The method as recited in claim 15, wherein the barrier is located between the recirculating air cavity and a seal in contact with the wall.

18. The method as recited in claim 15, wherein the vane platform supports a plurality of vanes.

19. The method as recited in claim 18, wherein a core airflow flows through the core gas passage, and the recirculating air cavity is configured to recirculate the secondary airflow.

20. A mid turbine frame module for a gas turbine engine comprising:

an outer turbine case about an axis;

an inner case about said axis;

a mid-turbine frame radially between said outer turbine case and said inner case, said mid turbine frame includes an inner vane platform, an outer vane platform and a plurality of vanes between said inner vane platform and said outer vane platform;

a seal in contact with said mid-turbine frame at a sealing surface; and a barrier transverse to said vane platform to at least partially shield said sealing surface from recirculating air within a recirculating air cavity adjacent to said inner platform, wherein said barrier extends toward but is not in contact with said outer vane platform, said barrier axially aligned with an edge of a vane that extends from said vane platform.

* * * * *